US008012221B2

(12) United States Patent
Hunger et al.

(10) Patent No.: US 8,012,221 B2
(45) **Date of Patent: *Sep. 6, 2011**

(54) PROCESS FOR SURFACE COLOURATION OF PAPER

(75) Inventors: Charles Hunger, Ettingen (CH); Michael Lennartz, Lörrach (DE)

(73) Assignee: BASF SE, Ludwigshafen (DE)

( * ) Notice: Subject to any disclaimer, the term of this patent is extended or adjusted under 35 U.S.C. 154(b) by 201 days.

This patent is subject to a terminal disclaimer.

(21) Appl. No.: 12/084,340

(22) PCT Filed: Nov. 1, 2006

(86) PCT No.: PCT/EP2006/068007

§ 371 (c)(1), (2), (4) Date: Apr. 29, 2008

(87) PCT Pub. No.: WO2007/054452

PCT Pub. Date: May 18, 2007

(65) Prior Publication Data

US 2009/0133201 A1 May 28, 2009

(30) Foreign Application Priority Data

Nov. 11, 2005 (EP) ..... 05110636

(51) Int. Cl.

| | |
|---|---|
| ***C09B 67/00*** | (2006.01) |
| ***C09B 62/00*** | (2006.01) |
| ***D06P 1/00*** | (2006.01) |
| ***B05D 3/12*** | (2006.01) |
| ***B05D 3/02*** | (2006.01) |
| ***C08L 89/00*** | (2006.01) |
| ***C08L 93/00*** | (2006.01) |
| ***C08L 3/00*** | (2006.01) |
| ***C09D 189/00*** | (2006.01) |
| ***C09D 193/00*** | (2006.01) |
| ***C09D 103/00*** | (2006.01) |
| ***C09J 189/00*** | (2006.01) |
| ***C09J 193/00*** | (2006.01) |
| ***C09J 103/00*** | (2006.01) |

(52) U.S. Cl. ..... 8/554; 8/543; 8/550; 8/551; 8/552; 8/636; 427/355; 427/385.5; 427/391; 427/394; 106/147.1; 106/206.1; 106/241

(58) Field of Classification Search ..... 8/536, 543, 8/550–552, 554, 636; 427/355, 385.5, 391, 427/394; 106/147.1, 206.1, 241
See application file for complete search history.

(56) References Cited

U.S. PATENT DOCUMENTS

| | | | | |
|---|---|---|---|---|
| 1,871,647 | A | | 8/1932 | Alden |
| 2,423,185 | A | * | 7/1947 | Gotte et al. ..... 442/83 |
| 3,706,524 | A | * | 12/1972 | Flensberg et al. ..... 8/531 |
| 4,206,306 | A | | 6/1980 | Bien et al. |
| 4,359,419 | A | | 11/1982 | Pociluyko ..... 260/176 |
| 4,372,815 | A | * | 2/1983 | Newkirk et al. ..... 162/158 |
| 4,398,915 | A | | 8/1983 | Panto et al. |
| 4,417,898 | A | | 11/1983 | Hasler et al. ..... 8/543 |
| 5,294,231 | A | * | 3/1994 | Palacin ..... 8/532 |
| 5,501,725 | A | * | 3/1996 | Lauw et al. ..... 106/31.32 |
| 5,824,190 | A | | 10/1998 | Guerro et al. ..... 162/135 |
| 5,910,623 | A | | 6/1999 | Kessel et al. ..... 8/402 |
| 5,929,215 | A | * | 7/1999 | Pedrazzi ..... 534/604 |
| 2003/0005527 | A1 | | 1/2003 | Deckers et al. ..... 8/536 |
| 2004/0099390 | A1 | | 5/2004 | Trochill et al. |
| 2004/0123404 | A1 | * | 7/2004 | Deckers et al. ..... 8/506 |
| 2004/0139566 | A1 | | 7/2004 | Szymanski |
| 2004/0204571 | A1 | | 10/2004 | He et al. |
| 2007/0266894 | A1 | | 11/2007 | Davenport et al. ..... 106/206.1 |

FOREIGN PATENT DOCUMENTS

| | | |
|---|---|---|
| DE | 196 08 580 | 9/1997 |
| EP | 1 435 410 | 7/2004 |
| WO | 03/004766 | 1/2003 |
| WO | WO 2004/035925 | 4/2004 |
| WO | 2004/090228 | 10/2004 |
| WO | WO 2005/052063 | 6/2005 |

OTHER PUBLICATIONS

Office Action dated Dec. 28, 2010 for U.S. Appl. No. 12/086,650.
Office Action dated Jul. 12, 2010 for U.S. Appl. No. 12/086,650.

* cited by examiner

*Primary Examiner* — Lorna M Douyon
*Assistant Examiner* — Tanisha Diggs
(74) *Attorney, Agent, or Firm* — Drinker Biddle & Reath

(57) ABSTRACT

The invention relates to a process for the surface coloration of paper characterized in that, in a first step, the paper surface is treated with a water soluble dye and, subsequently, in a second step, the paper surface is treated with a fixing agent.

6 Claims, No Drawings

PROCESS FOR SURFACE COLOURATION OF PAPER

This is an application filed under 35 U.S.C. 371 of PCT/EP2006/068007, filed on Nov. 1, 2006, which claims benefit of European Patent Application 05110636.7, filed Nov. 11, 2005.

The present invention relates to a process for the surface colouration of paper characterized in that, in a first step, the paper surface is treated with a water soluble dye and, subsequently, in a second step, the paper surface is treated with a fixing agent.

Despite the fact that the economical advantages of surface colouration of paper have long been recognized, in practice, surface colouration is not widespread when compared with stock dyeing. The main reason for this situation (see, for example, "On-machine surface coloration", A. S. Tindal, Surface Application of Paper Chemicals, 1997, 175-191) is that surface coloured paper generally exhibits poor bleed fastness when contacted with liquids such as water, alcohol or beverages.

One attempt to overcome this problem has been disclosed in WO 03/004766, whereby a dye composition containing a binder and thickener, which is a polyvinylpyrrolidone derivative, is applied to the paper surface. Preferably, the paper surface is treated with a fixing agent prior to the dyeing process in order to improve bleed fastness, but no concrete values are given to indicate the effectiveness of this approach.

A further composition for controlling the bleed fastness of organic colouring pigments in paper coatings has been disclosed in WO 2004/090228, whereby pigment compositions together with specific binders are applied to the paper surface. Whilst this approach is suited to colouring pigments, the problems associated with bleed fastness of conventional paper dyes in surface coatings have yet to be solved.

Surprisingly, it has now been found that by the use of a two-step process in which, after dyeing, the paper is treated with a fixing agent, dyeings are obtained in which the bleed fastness is vastly improved.

Consequently, the invention relates to a process for the surface colouration of paper characterized in that, in a first step, the paper surface is treated with a water soluble dye and, subsequently, in a second step, the paper surface is treated with a fixing agent.

Suitable water soluble dyes are those selected from the group consisting of anionic direct dyes, acid dyes, basic dyes, cationic direct dyes and reactive dyes. Examples of these various groups of dyes are disclosed in the Colour Index under the designations "C.I. Direct", "C.I. Acid", "C.I. Basic", and "C.I. Reactive" followed by the colour and the appropriate number.

Preferred dyes are anionic direct and reactive dyes.

Anionic direct dyes may be derived from a wide variety of chemical entities, but contain at least one sulphonic acid group, whereby the number of sulphonic acid groups is varied to obtain optimum affinity, whilst ensuring sufficient water solubility. In addition to sulphonic acid groups, carboxylic acid and phosphonic acid groups may also be present. Most preferred chemical entities are stilbene derivatives and, especially azo compounds. Preferred examples of anionic direct dyes are C.I. Direct yellows 11, 47, 50, 84, 137, 157 and 160, C.I. Direct Orange 29, C.I. Direct Reds 80, 81, 239, 254 and 262, C.I. Direct Violet 9 and 51 and C.I. Direct Blue 199 and 290, especially C.I. Direct Yellow 11, C.I. Direct Reds 81, 239, 254 and 262 and C.I. Direct Blue 199 and 290 although these examples are not intended to be restrictive in nature.

Preferred reactive dyes are, for example C.I. Reactive Yellow 42, C.I. Reactive Orange 134, C.I. Reactive Red 228 and C.I. Reactive Blue 21 and 260, although again these examples are not intended to be restrictive in nature.

Accordingly, in a first preferred aspect, the invention relates to a process for surface colouration of paper, wherein, in a first step, the paper is coated with a composition comprising a) a water soluble anionic direct dye, an acid dye or a reactive dye, optionally, b) a natural or synthetic binder or mixtures thereof, optionally, c) one or more auxiliaries and d) water and, in a second step, with a cationic fixing agent.

Preferably, the composition of the first step contains a binder. Suitable natural binders are starch and derivatives thereof. When starch is present in the composition, starch materials, useful as the binder component b) of the composition of the first step of the invention include practically all thinned starches of plant origin including starches from corn, wheat, potatoes, tapioca, rice, sago and sorghum. Waxy and high amylose starches may also be suitable. The starches can be thinned by acid hydrolysis, oxidative hydrolysis or enzymatic degradation. Further derivatized starches also suitable include those such as starch ethers, starch esters, cross-linked starches, oxidized starches and chlorinated starches, for example, carboxymethyl cellulose and hydroxyethyl methyl cellulose.

Alternatively, component b) of the invention may comprise a water insoluble synthetic polymer derived from one or more dienes and/or unsaturated monomers, such products being termed synthetic latex. Examples of diene monomers, suitable for the preparation of latex, may include 1,3-butadiene, isoprene, chloroprene, cyclobutadiene and divinyl benzene, whilst suitable unsaturated monomers may include alkyl acrylates and methacrylates, hydroxylated alkyl methacrylates, alkyl vinyl ketones, substituted acrylamides, methacrylic acid, N-methylol acrylamide, 2-hydroxyethyl acrylate, crotonic acid, itaconic acid, fumaric acid, maleic acid, maleic anhydride, vinyl halides, vinylidene halides, vinyl esters, vinyl ethers, vinyl carbazole, N-vinyl pyrrolidone, vinyl pyridine, chlorostyrene, alkyl styrene, ethylene, propylene, isobutylene, vinyl triethoxy silane and triphenyl vinyl silane. Preferred monomers include methyl methacrylate, dimethylamino ethyl acrylate, dimethylamino propyl acrylamide, vinyl acetate, acrylonitrile, acrylic acid, acrylamide, maleic anhydride, monovinyl silicon compounds including vinyl trimethyl silane, ethyl vinyl ether, chlorostyrene, vinyl pyridine, butyl vinyl ether, 2-ethylhexyl acrylate, isoprene and chloroprene; vinylidine chloride, butyl vinyl ether and, especially styrene, being particularly suitable. Most preferred latex is that derived from styrene and butadiene or acrylates and also a styrene/butadiene/starch copolymer such as the commercial product Pensize® 730, or a styrene/acrylate/starch copolymer such as the commercial product Raiprint® 501, whereby, in addition to starch, mixtures of preferred binders, i.e. starch and latex, may also be used.

Furthermore, the composition of the invention may contain further auxiliaries selected from sizing agents, fixing agents, additional binder and binder resins, insolubilizing and/or crosslinking agents, anionic, cationic and neutral polymers, wet-strength agents, antifoams and biocides.

Suitable auxiliaries may, for example, include polyethyleneimines and derivatives thereof, inorganic salts such as sodium chloride, magnesium chloride, calcium chloride and potassium chloride, alum, alkyl ketene dimers, polydiallyl dimethyl ammonium chloride, polyamide amine resins, polyvinyl alcohol, polyvinyl pyrrolidone and homo and copolymers thereof, polyesters and polyethers, glyoxal derivatives, monoethanolamine, acrylic acid/alkyl acrylate copolymers and styrene/acrylate copolymers.

Where anionic direct dyes or reactive dyes are employed in the first step of the process of the invention, the second step of the invention involves treatment of the paper surface with at least one cationic fixing agent. Preferred cationic fixing agents are selected from the group consisting of polyamines and derivatives thereof, polyimines and derivatives thereof, polyethylene imines and derivatives thereof, polyethylene amines and derivatives thereof, amine/amide condensates, diallyl dimethyl ammonium chloride (DADMAC) and polymers thereof, polyaluminium chloride, sodium chloride, magnesium chloride, calcium chloride and sodium chloride. Most preferred cationic fixing agents are polyethylene polyamine derivatives, aliphatic polyamines and amine/amide/formaldehyde condensation products, commercially available under the designations Tinofix® ECO-N, Tinofix® AP and Tinofix® ECO-WSP.

In a second preferred aspect, the invention relates to a process for surface colouration of paper, wherein, in a first step, the paper is coated with a composition comprising a) a water soluble cationic direct dye or a basic dye, optionally, b) a natural or synthetic binder or mixtures thereof, optionally, c) one or more auxiliaries and d) water and, in a second step, with an anionic fixing agent.

Preferably, the basic cationic dye is selected from the group consisting of mono-, bis-, and trisazahemicyanines and may be exemplified by C.I. Basic Red 46, C.I. Basic Blue 3 and 41, whilst preferred components b) and c) of the composition employed in the first step correspond to those described above for use with anionic or reactive dyes.

However, when basic dyes are applied to the paper, it is advantageous in the second step to utilize anionic fixing agents. Preferred anionic fixing agents are, for example, anionic starch or polymeric materials, i.e. latex, carrying anionic substituents, in addition to aliphatic amines such as diethanolamine, triethanolamine and desmorphen.

The quantities of the various components employed in the process of the invention may vary over wide ranges depending upon, for example, the depth of colour required and the method of application, particularly, by size press applications, the degree of pick-up.

However, in a further preferred aspect, the invention relates to a process whereby, in a first step, a composition comprising a) from 0.1 to 20%, preferably 0.5 to 10%, by weight of water soluble dye, b) from 0 to 20%, preferably 1 to 10%, by weight of a natural or synthetic binder or mixtures thereof, c) from 0 to 20%, preferably 0 to 10% by weight of one or more auxiliaries and d) water to 100% by weight is applied to the paper surface by means of a size press and, subsequently, without drying, in a second size press application, the paper surface is treated with an aqueous solution containing from 0.1 to 10%, preferably 1 to 5%, by weight of a fixing agent, hereafter the paper is subjected to drying.

Alternatively, the composition of the first step may be applied to the paper by a size press application, whilst the fixing agent is applied to the paper by means of spray techniques, such that, in a still further aspect, the invention relates to a process whereby, in a first step, a composition comprising a) from 0.1 to 20%, preferably 0.5 to 10%, by weight of water soluble dye, b) from 0 to 20%, preferably 1 to 10%, by weight of a natural or synthetic binder or mixtures thereof, c) from 0 to 20%, preferably 0 to 10% by weight of one or more auxiliaries and d) water to 100% by weight is applied to the paper surface by means of a size press and, subsequently, without drying, in a second step, the paper surface is sprayed with an aqueous solution containing from 0.1 to 10%, preferably 1 to 5%, by weight of a fixing agent, hereafter the paper is subjected to drying.

In one further possible method of application, both the dye and the fixing agent compositions may be applied to the paper surface by spray techniques, such that, in a still further aspect, the invention relates to a process whereby, in a first step, a composition comprising a) from 0.1 to 20%, preferably 0.5 to 10%, by weight of water soluble dye, b) from 0 to 20%, preferably 1 to 10%, by weight of a natural or synthetic binder or mixtures thereof, c) from 0 to 20%, preferably 0 to 10% by weight of one or more auxiliaries and d) water to 100% by weight is applied to the paper surface by means of spraying and, subsequently, without drying, in a second step, the paper surface is sprayed with an aqueous solution containing from 0.1 to 10%, preferably 1 to 5%, by weight of a fixing agent, hereafter the paper is subjected to drying.

The paper resulting from treatment by any of the processes described above constitutes one further aspect of the invention.

The following examples serve to illustrate the invention without intending to be restrictive in nature; Parts and percentages are by weight unless otherwise stated.

EXAMPLES

I. Size Press Application of Anionic Direct Dye and of Fixing Agent

Base Paper:

The base paper used for the application was fabricated on a laboratory paper machine at UMIST, Manchester, UK from a 70/30 mixture of hard and soft woods pulp beaten to 35° SR, containing 10% retained clay (plus 1% calcium carbonate) filler, 0.4% Hercat®27JP pseudo neutral size, 1% alum and 0.02% Percol® 230 retention agent. The resulting paper has a base weight of 103 g/m$^2$ and a Cobb value of 95 g/m$^2$.

Application:

In a Mathis size press running at 5 m/min., with a pressure of 200 kPas and at a temperature of 50° C., the base paper is firstly treated with a solution containing the defined amounts of dye (see Table 1), 6 g of Raiprint® 501 (styrene/acrylate/starch copolymer) binder, when present, (see Table 1) and 44 g of a 10% aqueous solution of size press starch (Perfectamyl® 4692), the bath being made up to 100 g with water.

The moist dyeing is then, in a second size press application, treated with solutions containing 1, 2.5 and 5% Tinofix® ECO-N fixing agent, after which the paper is dried.

The resulting colour strengths of the dyeings are then measured, whereby the values given in Table 1 are corrected to take into account the amount of dye actually residing on the paper surface.

Additionally, the bleed fastness of the dyeings towards water and 50% alcohol/water are measured by firstly moistening the dyeing with deionised water and alcohol/water respectively and placing the moist dyeings between two sheets of white filter papers which are moistened with deionised water and alcohol/water respectively. The resulting sandwich is placed between two glass plates weighted with a 1 kg weight. After 1 hour at room temperature, the individual sheets are dried and the bleed fastness assessed by means of the grey scale, whereby a value between 1 (very strong bleeding) and 5 (zero bleeding) is assigned.

The results of the measurements are summarized in the following Table 1 below:

TABLE 1

| E.g. No. | Dye/%[1] | Binder[2] | % Pick-up | % Fixative | % Pick-up | Colour Strength % | Bleed: water | Bleed: alcohol |
|---|---|---|---|---|---|---|---|---|
| 1a | DB 290/2 | St | 55.2 | None | | 100 | 2 | 2 |
| 1b | DB 290/2 | St | 53.3 | 1 | 28.5 | 102 | 4-5 | 4-5 |
| 1c | DB 290/2 | St | 54.5 | 2.5 | 27.9 | 103 | 4-5 | 5 |
| 1d | DB 290/2 | St | 51.2 | 5 | 29.5 | 109 | 3-4 | 5 |
| 2a | DB 290/2 | St/Lat | 45.2 | None | | 109 | 2+ | 2 |
| 2b | DB 290/2 | St/Lat | 48.2 | 1 | 28.9 | 102 | 4-5+ | 4-5 |
| 2c | DB 290/2 | St/Lat | 44.2 | 2.5 | 29.7 | 116 | 4-5+ | 5 |
| 2d | DB 290/2 | St/Lat | 45.5 | 5 | 26.1 | 123 | 4-5 | 5 |
| 3a | DY 11/2 | St | 60.6 | None | | 100 | 2 | 1-2+ |
| 3b | DY 11/2 | St | 56.0 | 1 | 28.3 | 106 | 3+ | 2-3 |
| 3c | DY 11/2 | St | 60.6 | 2.5 | 26.7 | 98 | 4+ | 3-4 |
| 3d | DY 11/2 | St | 57.6 | 5 | 27.9 | 100 | 5 | 5 |
| 4a | DY 11/2 | St/Lat | 51.8 | None | | 105 | 2 | 1-2+ |
| 4b | DY 11/2 | St/Lat | 53.3 | 1 | 28.5 | 106 | 3-4 | 2-3 |
| 4c | DY 11/2 | St/Lat | 50.3 | 2.5 | 29.7 | 107 | 4-5 | 4-5 |
| 4d | DY 11/2 | St/Lat | 53.0 | 5 | 29.3 | 114 | 5 | 5 |
| 5a | DB 199/4 | St | 49.7 | None | | 100 | 2 | 2 |
| 5b | DB 199/4 | St | 52.1 | 1 | 33.1 | 107 | 4-5 | 4-5+ |
| 5c | DB 199/4 | St | 50.0 | 2.5 | 32.1 | 106 | 4-5 | 5 |
| 5d | DB 199/4 | St | 51.9 | 5 | 29.0 | 105 | 4-5 | 5 |
| 6a | DB 199/4 | St/Lat | 50.6 | None | | 111 | 2-3 | 2 |
| 6b | DB 199/4 | St/Lat | 48.8 | 1 | 29.6 | 114 | 4-5+ | 4-5+ |
| 6c | DB 199/4 | St/Lat | 47.8 | 2.5 | 31.7 | 118 | 4-5+ | 5 |
| 6d | DB 199/4 | St/Lat | 46.0 | 5 | 27.3 | 122 | 4-5+ | 5 |
| 7a | DR 239/2 | St | 53.3 | None | | 100 | 2+ | 2 |
| 7b | DR 239/2 | St | 47.9 | 1 | 30.8 | 115 | 4-5+ | 4-5 |
| 7c | DR 239/2 | St | 46.4 | 2.5 | 29.4 | 115 | 4-5 | 5 |
| 7d | DR 239/2 | St | 46.4 | 5 | 30.1 | 121 | 4 | 5 |
| 8a | DR 239/2 | St/Lat | 47.9 | None | | 111 | 2-3 | 2 |
| 8b | DR 239/2 | St/Lat | 47.3 | 1 | 31.1 | 112 | 5 | 4-5 |
| 8c | DR 239/2 | St/Lat | 46.1 | 2.5 | 32.3 | 118 | 5 | 5 |
| 8d | DR 239/2 | St/Lat | 47.5 | 5 | 24.7 | 117 | 4-5 | 5 |
| 9a | DR 254/2 | St | 48.2 | None | | 100 | 1-2+ | 1-2 |
| 9b | DR 254/2 | St | 53.9 | 1 | 27.9 | 101 | 2-3 | 2 |
| 9c | DR 254/2 | St | 51.5 | 2.5 | 29.3 | 112 | 3-4 | 2-3+ |
| 9d | DR 254/2 | St | 48.2 | 5 | 30.4 | 122 | 3 | 3-4 |
| 10a | DR 254/2 | St/Lat | 48.2 | None | | 110 | 1-2 | 1-2 |
| 10b | DR 254/2 | St/Lat | 49.1 | 1 | 28.1 | 111 | 2-3 | 2 |
| 10c | DR 254/2 | St/Lat | 50.6 | 2.5 | 28.9 | 120 | 3 | 2-3 |
| 10d | DR 254/2 | St/Lat | 49.1 | 5 | 29.3 | 132 | 4 | 3 |

[1]DB = C.I. Direct Blue; DY = C.I. Direct Yellow; DR = C.I. Direct Red

[2]St = Starch; Lat = Raiprint ® 501 (Styrene/Acrylate/Starch copolymer)

The above results demonstrate the improved bleed fastness of the dyes towards both water and alcohol resulting from their application according to the method of the invention.

II. Size Press Application of Anionic Direct Dye and Spraying of Fixing Agent In a further series of experiments, the anionic direct dyes are again applied in the size press, as described above, whilst the fixing agent, at concentrations of 1 and 3%, is applied by spraying with a commercially available hand sprayer designed for spraying paint and aqueous solutions (Wagner W 600).

The results of the experiments are collated in Table 2 below:

TABLE 2

| E.g. No. | Dye/%[1] | Binder[2] | % Pick-up | % Fixative | % Pick-up | Colour Strength % | Bleed: water | Bleed: alcohol |
|---|---|---|---|---|---|---|---|---|
| 11a | DB 290/2 | St | 50.3 | None | | 100 | 2 | 2+ |
| 11b | DB 290/2 | St | 50.3 | 1 | 98.2 | 102 | 4-5 | 4-5+ |
| 11c | DB 290/2 | St | 48.8 | 3 | 95.1 | 117 | 3 | 4-5+ |
| 12a | DB 290/2 | St/Lat | 43.9 | None | | 108 | 2+ | 2 |
| 12b | DB 290/2 | St/Lat | 42.4 | 1 | 98.8 | 122 | 3-4 | 4-5+ |
| 12c | DB 290/2 | St/Lat | 42.7 | 3 | 104.9 | 130 | 3-4 | 4-5+ |
| 13a | DY 11/2 | St | 61.3 | None | | 100 | 2-3 | 1-2 |
| 13b | DY 11/2 | St | 58.5 | 1 | 72.0 | 102 | 4 | 3 |
| 13c | DY 11/2 | St | 54.3 | 3 | 66.7 | 112 | 4-5 | 4-5+ |
| 14a | DY 11/2 | St/Lat | 54.3 | None | | 105 | 2-3 | 1-2 |
| 14b | DY 11/2 | St/Lat | 53.1 | 1 | 101.3 | 119 | 4-5 | 4-5 |
| 14c | DY 11/2 | St/Lat | 56.0 | 3 | 86.8 | 100 | 4 | 5 |
| 15a | DB 199/4 | St | 46.3 | None | | 100 | 2+ | 2-3 |
| 15b | DB 199/4 | St | 44.2 | 1 | 95.8 | 124 | 4-5+ | 4-5+ |
| 15c | DB 199/4 | St | 45.2 | 3 | 90.4 | 112 | 4 | 4-5+ |
| 16a | DB 199/4 | St/Lat | 42.8 | None | | 112 | 2-3 | 2-3 |
| 16b | DB 199/4 | St/Lat | 43.3 | 1 | 112.8 | 131 | 4-5+ | 5 |
| 16c | DB 199/4 | St/Lat | 43.6 | 3 | 102.4 | 114 | 4 | 5 |
| 17a | DR 239/2 | St | 52.4 | None | | 100 | 2-3 | 2 |
| 17b | DR 239/2 | St | 52.4 | 1 | 101.2 | 112 | 4+ | 5 |
| 17c | DR 239/2 | St | 54.9 | 3 | 85.8 | 109 | 3 | 5 |
| 18a | DR 239/2 | St/Lat | 52.8 | None | | 100 | 2-3 | 2 |
| 18b | DR 239/2 | St/Lat | 46.9 | 1 | 104.3 | 123 | 4+ | 5 |
| 18c | DR 239/2 | St/Lat | 47.9 | 3 | 115.6 | 131 | 3+ | 5 |
| 19a | DR 254/2 | St | 51.2 | None | | 100 | 1-2 | 1-2+ |
| 19b | DR 254/2 | St | 49.1 | 1 | 97.0 | 105 | 3 | 3 |
| 19c | DR 254/2 | St | 49.7 | 3 | 92.8 | 115 | 3 | 4-5 |
| 20a | DR 254/2 | St/Lat | 48.8 | None | | 111 | 1-2+ | 1-2 |
| 20b | DR 254/2 | St/Lat | 50.3 | 1 | 92.6 | 129 | 3-4 | 3 |
| 20c | DR 254/2 | St/Lat | 51.2 | 3 | 92.0 | 111 | 2-3+ | 4-5 |

[1]DB = C.I. Direct Blue; DY = C.I. Direct Yellow; DR = C.I. Direct Red

[2]St = Starch; Lat = Raiprint ® 501 (Styrene/Acrylate/Starch copolymer)

III. Size Press Application of Reactive Dye and of Fixing Agent

In a third series of experiments, the direct dyes of application I were replaced by reactive dyes and again applied in the size press to the base paper as described under Pt. I above, whereby the Raiprint® 501 (Styrene/Acrylate/Starch copolymer) binder is replaced by 5 g of Pensize® 730 a Styrene/Butadiene/Starch Copolymer.

In a second size press, 1, 2.5 and 5% solutions of the fixing agent, Tinofix® ECO-N, are then applied to the damp dyeing as described above.

The results of the experiments are summarized in the following Table 3:

TABLE 3

| E.g. No. | Dye/%[1] | Binder[2] | % Pick-up | % Fixative | % Pick-up | Colour Strength % | Bleed: water | Bleed: alcohol |
|---|---|---|---|---|---|---|---|---|
| 21a | RB 260/1.9 | St | 50.6 | None | | 100 | 1-2+ | 1-2 |
| 21b | RB 260/1.9 | St | 49.1 | 1 | 33.5 | 115 | 1-2+ | 1-2 |
| 21c | RB 260/1.9 | St | 48.8 | 2.5 | 31.0 | 100 | 2+ | 2 |
| 21d | RB 260/1.9 | St | 51.1 | 5 | 30.4 | 100 | 4-5 | 3 |
| 22a | RB 260/1.9 | St/Pen | 46.2 | None | | 100 | 1-2 | 1-2+ |
| 22b | RB 260/1.9 | St/Pen | 47.0 | 1 | 33.7 | 111 | 2 | 1-2+ |
| 22c | RB 260/1.9 | St/Pen | 45.2 | 2.5 | 31.9 | 100 | 2-3 | 2 |
| 22d | RB 260/1.9 | St/Pen | 43.6 | 5 | 30.3 | 103 | 4-5 | 3 |
| 23a | RO 134/1.25 | St | 54.9 | None | | 100 | 1-2+ | 1-2+ |
| 23b | RO 134/1.25 | St | 57.2 | 1 | 28.3 | 97 | 2 | 2 |
| 23c | RO 134/1.25 | St | 48.8 | 2.5 | 30.6 | 104 | 3-4 | 2+ |
| 23d | RO 134/1.25 | St | 52.2 | 5 | 29.2 | 112 | 4-5 | 3-4+ |
| 24a | RO 134/1.25 | St/Pen | 45.7 | None | | 98 | 1-2+ | 1-2+ |
| 24b | RO 134/1.25 | St/Pen | 43.3 | 1 | 31.1 | 105 | 2-3 | 2 |
| 24c | RO 134/1.25 | St/Pen | 45.1 | 2.5 | 28.7 | 102 | 3-4 | 2-3 |
| 24d | RO 134/1.25 | St/Pen | 41.2 | 5 | 25.5 | 106 | 4-5+ | 4-5 |

[1]RB = C.I. Reactive Blue; RO = C.I. Reactive Orange

[2]St = Starch; Pen = Pensize ® 730 (Styrene/Butadiene/Starch Copolymer)

IV. Size Press Application of Reactive Dye and Spraying of Fixing Agent

A further series of experiments is performed by size press application of the reactive dye followed by spray application of the fixing agent, Tinofix® ECO-N, at concentrations of 1 and 3%, as described in Pt.II above.

The results are summarized in the following Table 4:

TABLE 4

| E.g. No. | Dye/%[1] | Binder[2] | % Pick-up | % Fixative | % Pick-up | Colour Strength % | Bleed: water | Bleed: alcohol |
|---|---|---|---|---|---|---|---|---|
| 25a | RB 260/1.9 | St | 59.0 | None | | 100 | 1-2 | |
| 25b | RB 260/1.9 | St | 59.4 | 1 | 78.8 | 122 | 2+ | |
| 25c | RB 260/1.9 | St | 58.5 | 3 | 87.2 | 87 | 3-4 | |
| 26a | RB 260/1.9 | St/Pen | 47.6 | None | | 107 | 1-2 | |
| 26b | RB 260/1.9 | St/Pen | 40.0 | 1 | 111.3 | 112 | 3 | |
| 26c | RB 260/1.9 | St/Pen | 49.7 | 3 | 103.0 | 94 | 4 | |
| 27a | RO 134/1.25 | St | 51.5 | None | | 100 | 1-2+ | 1-2+ |
| 27b | RO 134/1.25 | St | 54.2 | 1 | 82.5 | 97 | 2-3 | 2+ |
| 27c | RO 134/1.25 | St | 58.4 | 3 | 86.1 | 102 | 4+ | 4-5 |
| 28a | RO 134/1.25 | St/Pen | 46.4 | None | | 108 | 1-2+ | 1-2+ |
| 28b | RO 134/1.25 | St/Pen | 51.8 | 1 | 89.3 | 92 | 3 | 2-3 |
| 28c | RO 134/1.25 | St/Pen | 46.7 | 3 | 110.8 | 106 | 4+ | 4-5+ |
| 29a | RY 42/1.7 | St | 63.6 | None | | 100 | 1-2+ | 2 |
| 29b | RY 42/1.7 | St | 63.6 | 1 | 70.9 | 115 | 1-2+ | 2 |
| 29c | RY 42/1.7 | St | 60.6 | 3 | 84.9 | 106 | 4+ | 2 |
| 30a | RY 42/1.7 | St/Pen | 57.2 | None | | 97 | 1-2+ | 2 |
| 30b | RY 42/1.7 | St/Pen | 43.4 | 1 | 75.3 | 133 | 1-2+ | 2+ |
| 30c | RY 42/1.7 | St/Pen | 57.1 | 3 | 91.7 | 96 | 4-5 | 2 |
| 31a | RR 228/1.55 | St | 56.9 | None | | 100 | 1-2 | 1-2 |
| 31b | RR 228/1.55 | St | 57.4 | 1 | 102.4 | 113 | 2+ | 2+ |
| 31c | RR 228/1.55 | St | 57.4 | 3 | 85.8 | 115 | 4-5 | 4-5 |
| 32a | RR 228/1.55 | St/Pen | 50.6 | None | | 102 | 1-2 | 1-2 |
| 32b | RR 228/1.55 | St/Pen | 50.0 | 1 | 100.0 | 105 | 2-3 | 2+ |
| 32c | RR 228/1.55 | St/Pen | 50.6 | 3 | 102.4 | 122 | 4+ | 4-5 |
| 33a | RR 228/1.55 | Pen | 47.3 | None | | 100 | 1-2+ | 1-2+ |
| 33b | RR 228/1.55 | Pen | 46.6 | 1 | 164.6 | 101 | 5 | 4-5 |
| 33c | RR 228/1.55 | Pen | 47.0 | 2 | 95.2 | 98 | 5 | 4-5+ |
| 34a | RB 21/4 | St | 54.7 | None | | 100 | 1-2+ | |
| 34b | RB 21/4 | St | 56.8 | 1 | 81.7 | 113 | 2 | |
| 34c | RB 21/4 | St | 50.3 | 3 | 95.9 | 107 | 4-5 | |
| 35a | RB 21/4 | St/Pen | 44.7 | None | | 111 | 1-2+ | |
| 35b | RB 21/4 | St/Pen | 44.1 | 1 | 110.6 | 119 | 2+ | |
| 35c | RB 21/4 | St/Pen | 41.2 | 3 | 105.9 | 132 | 4-5+ | |

[1]RY = C.I. Reactive Yellow; RR = C.I. Reactive Red

[2]Where Pensize ® 730 is the sole binder, no starch solution is added and 8.0 g thereof are added to the size press bath which is then made up to 100 g with water V. Comparison between 2-Step and 1-Step Surface Dyeing and Fixation In a further series of experiments, the advantages of the 2-step dyeing and fixation process of the invention are demonstrated as follows:

In a first size press application, anionic direct dyes (C.I. Direct Red 239 and C.I. Direct Red 254, respectively) were applied to the base paper of Pt. 1 together with either starch alone or a combination of starch and Pensize® 730 (6 g) or starch and Raiprint® 501 (6 g) in a size press bath as described under Pt. 1. In a second application, prior to drying, a 0.7% solution of Tinofix® ECO-N is then applied to the paper by spraying, as described above under Pt. 2 and subsequently dried.

As a direct comparison, dyes, binders and fixing agent (at concentrations of 0.4 and 0.7%) were added together to the size press bath and applied, in a single step, to the paper surface in the size press as described under Pt. 1 above and subsequently dried.

The results of the comparative experiments are summarized in the following Table 5, whereby Examples designated with the letters a), c) and e) are not treated with fixative, Examples designated with letters b), d) and f) correspond to Examples of the invention, whilst Examples designated with the letters g), h), i), j), k) and l) correspond to the one-step size press application process for comparative purposes:

TABLE 5

| E.g. No. | Dye/% | Binder | % Pick-up | % Fixative | % Pick-up | Colour Strength % | Bleed: water[1] | Bleed: alcohol |
|---|---|---|---|---|---|---|---|---|
| 36a | DR 239/2 | St | 50.6 | None | | 100 | 2+ | 2+ |
| 36b | DR 239/2 | St | 50.0 | 0.7 | 47 | 99 | 5 | 4-5 |
| 36c | DR 239/2 | St/Pen | 44.6 | None | | 101 | 2-3 | 1-2 |
| 36d | DR 239/2 | St/Pen | 46.3 | 0.7 | 34 | 103 | 5 | 3-4+ |
| 36e | DR 239/2 | St/Lat | 54.9 | None | | 103 | 2-3 | 3-4 |
| 36f | DR 239/2 | St/Lat | 54.3 | 0.7 | 45 | 104 | 4-5 | 2-3 |
| 36g | DR 239/2 | St | 47.9 | 0.4 | | 67 | 4 | 3 |
| 36h | DR 239/2 | St | 47.9 | 0.7 | | 22 | Pptn. | Pptn. |
| 36i | DR 239/2 | St/Pen | 45.2 | 0.4 | | 57 | 4 | 3 |
| 36j | DR 239/2 | St/Pen | 43.7 | 0.7 | | 22 | Pptn. | Pptn. |
| 36k | DR 239/2 | St/Lat | 47.2 | 0.4 | | 46 | 4-5+ | 3 |
| 36l | DR 239/2 | St/lat | 50.3 | 0.7 | | 18 | Pptn. | Pptn. |
| 37a | DR 254/2 | St | 54.2 | None | | 100 | 1+ | 1+ |
| 37b | DR 254/2 | St | 56.5 | 0.7 | 51 | 101 | 2-3 | 2 |
| 37c | DR 254/2 | St/Pen | 46.7 | None | | 106 | 1-2 | 1-2+ |
| 37d | DR 254/2 | St/Pen | 46.5 | 0.7 | 33 | 106 | 2 | 1-2+ |
| 37e | DR 254/2 | St/Lat | 56.0 | None | | 107 | 1-2 | 1+ |
| 37f | DR 254/2 | St/Lat | 49.7 | 0.7 | 34 | 119 | 2 | 1-2 |
| 37g | DR 254/2 | St | 55.1 | 0.4 | | 63 | 2− | 2+ |
| 37h | DR 254/2 | St | 58.8 | 0.7 | | 8 | Pptn. | Pptn. |
| 37i | DR 254/2 | St/Pen | 49.1 | 0.4 | | 58 | 2 | 2 |
| 37j | DR 254/2 | St/Pen | 49.4 | 0.7 | | 20 | Pptn. | Pptn |
| 37k | DR 254/2 | St/Lat | 46.1 | 0.4 | | 61 | 2 | 2 |
| 37l | DR 254/2 | St/Lat | 48.8 | 0.7 | | 13 | Pptn. | Pptn. |

[1]Pptn. = Precipitation

Clearly, the results of the above demonstrate not only the improved effects of the fixing agent in a 2-step process, but also the vast improvement in colour strength by employing the process of the invention in comparison to a single step process, whereby, in particular, the loss of colour strength resulting from a one-step application is apparent.

VI. Spray Application of Anionic Direct Dye and of Fixing Agent

In a final series of experiments, anionic direct dyes (C.I. Direct Red 239 and C.I. Direct Red 254, respectively) were applied to either unsized or offset neutral sized (ONS) papers, either directly after formation on a laboratory paper machine (35% dry weight of paper), or after drying. Thereafter, in a second spray application, the dyeing is treated with a 1% solution of the fixing agent Tinofix® WSP and subsequently dried.

The spray applications are performed using a commercially available hand sprayer for paints and aqueous solutions (Wagner W 600).

The results of the experiments are summarized in the following Table 6:

TABLE 6

| Example No. | Dye/% | Base Paper | Paper status | % Fixative | Colour strength % | Bleed: Water[1] |
|---|---|---|---|---|---|---|
| 38a | DR 254/1 | Unsized | Wet | | 100 | 3 |
| 38b | DR 254/1 | Unsized | Wet | 1 | 89 | 5 |
| 39a | DR 254/1 | Unsized | Dry | | 66 | 3 |
| 39b | DR 254/1 | Unsized | Dry | 1 | 55 | 5– |
| 40a | DR 254/1 | ONS | Wet | | 100 | 2-3 |
| 40b | DR 254/1 | ONS | Wet | 1 | 92 | 4-5 |
| 41a | DR 254/1 | ONS | Dry | | 64 | 4 |
| 41b | DR 254/1 | ONS | Dry | 1 | 59 | 5 |
| 42a | DR 239/1 | Unsized | Wet | | 100 | 3 |
| 42b | DR 239/1 | Unsized | Wet | 1 | 101 | 5 |
| 43a | DR 239/1 | ONS | Wet | | 57 | 3-4 |
| 43b | DR 239/1 | ONS | Wet | 1 | 84 | 5 |

[1]The bleed fastness test was performed as described in Pt.1, except that the filter papers were replaced by fiberglass sheets The results clearly demonstrate the improvement in bleed fastness of the dyes towards water also by spraying the components, according to the method of the invention.

The invention claimed is:

1. A process for the surface coloration of paper said process comprising a first step and a second step, said first step comprising coating a surface of a paper with a coating composition comprising a) a water soluble anionic direct dye or a reactive dye, wherein said water soluble anionic direct dye is selected from the group consisting of C.I. Direct Yellows 11, 47, 50, 84, 137, 157, and 160; C.I. Direct Reds 80, 81, 239, 254, and 262; C.I. Direct Violets 9 and 51; and C.I. Direct Blues 199 and 290; and said reactive dye is selected from the group consisting of C.I. Reactive Yellow 42, C.I. Reactive Orange 134, C.I. Reactive Red 228, C.I. Reactive Blue 21, and C.I. Reactive Blue 260;

b) a binder selected from the group consisting of starch, a styrene/acrylate/starch copolymer, a styrene/butadiene/starch copolymer, and mixtures thereof;

c) optionally, one or more auxiliaries; and d) water; and said second step comprising coating the surface of the paper with a fixing composition comprising a cationic fixing agent, wherein said cationic fixing agent is selected from the group consisting of polyethylene polyamine derivatives, aliphatic polyamines, and amine/amide/formaldehyde condensation products;

wherein said paper is dried after said second step, without drying said paper between said first and said second steps.

2. The process according to claim 1, wherein the binder is starch.

3. The process according to claim 1, wherein said first step further comprises using a size press to apply said coating composition, said coating composition comprising a) from 0.1 to 20% by weight of said water soluble anionic direct dye;

b) said binder selected from the group consisting of starch, a styrene/acrylate/starch copolymer, a styrene/butadiene/starch copolymer, and mixtures thereof wherein said binder is present in an amount up to 20% by weight; thereof;

c) from 0 to 20% by weight of said one or more auxiliaries; and d) water to 100% by weight; and said second step further comprises using a second size press to apply said fixing composition, said fixing composition comprising an aqueous solution containing from 0.1 to 10% by weight of said cationic fixing agent selected from the group consisting of polyethylene polyamine derivatives, aliphatic polyamines, and amine/amide/formaldehyde condensation products.

4. The process according to claim 1, wherein said first step further comprises using a size press to apply said coating composition, said coating composition comprising a) from 0.1 to 20% by weight of said water soluble anionic direct dye;

b) said binder selected from the group consisting of starch, a styrene/acrylate/starch copolymer, a styrene/butadiene/starch copolymer, and mixtures thereof wherein said binder is present in an amount up to 20% by weight;

c) from 0 to 20% by weight of said one or more auxiliaries; and d) water to 100% by weight; and said second step further comprises spraying said fixing composition onto the surface of said paper, said fixing composition comprising an aqueous solution containing from 0.1 to 10% by weight of said cationic fixing agent selected from the group consisting of polyethylene polyamine derivatives, aliphatic polyamines, and amine/amide/formaldehyde condensation products.

5. The process according to claim 1, wherein said first step further comprises spraying said coating composition onto said surface of said paper, said coating composition comprising a) from 0.1 to 20% by weight of said water soluble anionic direct dye;

b) said binder selected from the group consisting of starch, a styrene/acrylate/starch copolymer, a styrene/butadiene/starch copolymer, and mixtures thereof wherein said binder is present in an amount up to 20% by weight;

c) from 0 to 20% by weight of said one or more auxiliaries; and d) water to 100% by weight; and said second step further comprises spraying said fixing composition onto the surface of said paper, said fixing composition comprising an aqueous solution containing from 0.1 to 10% by weight of said cationic fixing agent selected from the group consisting of polyethylene polyamine derivatives, aliphatic polyamines, and amine/amide/formaldehyde condensation products.

6. Paper prepared according to the process of claim 1.

* * * * *